US009540151B2

(12) United States Patent
Niggel

(10) Patent No.: US 9,540,151 B2
(45) Date of Patent: Jan. 10, 2017

(54) TWIST CLOSURE FOR OPENING AND CLOSING CONTAINERS

(71) Applicant: Berlin Packaging, LLC, Chicago, IL (US)

(72) Inventor: Brett Niggel, Chicago, IL (US)

(73) Assignee: Berlin Packaging, LLC, Chicago, IL (US)

( * ) Notice: Subject to any disclaimer, the term of this patent is extended or adjusted under 35 U.S.C. 154(b) by 98 days.

(21) Appl. No.: 14/640,265

(22) Filed: Mar. 6, 2015

(65) Prior Publication Data

US 2016/0257450 A1 Sep. 8, 2016

(51) Int. Cl.
*B65D 41/02* (2006.01)

(52) U.S. Cl.
CPC ..... *B65D 41/02* (2013.01)

(58) Field of Classification Search
CPC . B65D 21/0223; B65D 47/263; B65D 47/265; B65D 47/2018; B65D 50/041; B65D 50/045; B65D 51/18; B65D 51/24; B65D 51/245; B65D 55/02; B65D 55/022; B65D 2215/02; A61J 1/03; A61J 7/0436; A47G 19/2272; B67D 7/0294
USPC ..... 215/206, 208, 219, 228, 230, 316; 220/23.4, 212, 288, 254.1, 254.4, 220/254.8–254.9, 256.1, 259.3, 301, 713, 220/790; 222/153.1, 153.14, 548; 221/130, 152, 265, 277; D7/392.1, 396.2; D9/440, 447, 449–450; 206/459.1, 459.5, 206/534
See application file for complete search history.

(56) References Cited

U.S. PATENT DOCUMENTS

| | | | | | |
|---|---|---|---|---|---|
| 3,073,468 | A * | 1/1963 | Arneson | B65D 55/026 | 215/230 |
| 4,444,328 | A * | 4/1984 | Glass | B65D 47/265 | 215/230 |
| 4,653,672 | A * | 3/1987 | Tuerk | B65D 47/263 | 215/216 |
| D291,536 | S | 8/1987 | Crawford | | |
| 5,358,146 | A | 10/1994 | Stull | | |
| 5,520,307 | A * | 5/1996 | Miller | G07F 11/44 | 206/459.5 |
| 5,680,951 | A | 10/1997 | Feltman, III | | |
| 6,003,467 | A * | 12/1999 | Shelton-Ferrell | G09F 11/23 | 116/308 |
| D435,793 | S | 1/2001 | Kreiseder | | |
| D438,114 | S | 2/2001 | Stonberg | | |
| D474,068 | S | 5/2003 | Fujii | | |
| D481,948 | S | 11/2003 | Brozell | | |
| 7,201,288 | B2 | 4/2007 | von Ronn | | |
| 8,286,812 | B2 * | 10/2012 | Buczkowski | B65D 51/245 | 215/219 |
| 8,393,487 | B1 | 3/2013 | Pillers | | |
| 8,561,857 | B2 | 10/2013 | DeMarco | | |
| 8,689,988 | B2 * | 4/2014 | Xu | A61J 7/04 | 116/308 |
| 8,813,987 | B2 | 8/2014 | Oelz | | |
| 2004/0256421 | A1 | 12/2004 | Werth | | |
| 2006/0096983 | A1 | 5/2006 | Patterson | | |
| 2007/0187406 | A1 | 8/2007 | Nobile | | |

(Continued)

*Primary Examiner* — J. Gregory Pickett
*Assistant Examiner* — Brijesh V. Patel
(74) *Attorney, Agent, or Firm* — Adam K. Sacharoff; Much Shelist

(57) ABSTRACT

In one embodiment there is provided a twist closure combined with a bottle. The shell is secured between the twist closure that permits rotation of the closure with respect to the bottle while keeping the closure secured thereto. Rotation of the closure moves an orifice from a raised segment closing the bottle to an notched segment that permits the contents of the bottle to flow out of the orifice.

15 Claims, 10 Drawing Sheets

(56) References Cited

U.S. PATENT DOCUMENTS

| | | | | |
|---|---|---|---|---|
| 2009/0236305 | A1* | 9/2009 | DeMarco | B65D 51/18 215/316 |
| 2010/0001897 | A1 | 1/2010 | DeMarco | |
| 2010/0018975 | A1* | 1/2010 | DeMarco | B65D 47/265 220/253 |
| 2013/0062346 | A1* | 3/2013 | Killinger | A61M 1/0001 220/212 |

* cited by examiner

TWIST CLOSURE FOR OPENING AND CLOSING CONTAINERS

FIELD OF THE INVENTION

The present invention relates to a container with a twist closure.

BACKGROUND OF THE INVENTION

Many containers, particularly bottles containing dispensing fluids have closures or caps which are twisted or pulled to open a passage for dispensing the liquid, and provide a seal to close the container and prevent leaking when not in use. There is a continual need to improve upon the prior art and develop other technologies to provide a twist container closure. One of which is provided by the present invention.

SUMMARY OF THE INVENTION

In one embodiment of the present invention there is provided a twist closure having a bottle, a shell secured about the bottle, and a closure rotatably secured about the shell. The bottle has a central bottle orifice through which contents of the bottle may flow through. The bottle has a bottle surface wall terminating to a bottle shoulder. The bottle shoulder extends to a bottle well surrounding the central bottle orifice. The shell includes an outer shell wall annually extending around the bottle well. The shell further has an upper surface including a raised segment and a notched segment and terminating annually towards a central well positioned about the central bottle orifice. The central well includes first and second downwardly extending side walls. And the first and second downwardly extending side walls are connected to an annual base wall at a spaced distance to form an annual channel therebetween. The first downwardly extending side wall is configured to abut an inside portion of the bottle well, and wherein the first and second downwardly extending side walls further include notches configured at an adjacent position to the notched segment. The twist closure is rotatably secured on to the shell and has a top surface with a downwardly extending skirt fitted about the outer shell wall of the shell. The top surface has a top orifice sized to receive the raised segment when the closure is in a closed configuration about the bottle. The top orifice is configured to rotate to position over the notched segment when in an opened configuration allowing contents in the bottle to flow through the notches in the first and second downwardly extending side was into the notched segment and out the top orifice.

In other aspects, the closure further includes a curved groove positioned in the top surface and configured to provide the raised segment with a travel region when the closure is rotating between the open and closed configurations. In addition, the closure includes first and second annual walls extending downwardly from an underside of the top surface. The first annual wall is spaced from the second annual wall such that the first annual wall is configured to fit into the channel between the first and second downwardly extending side walls, with the second annual wall abutting an inside portion of the second downwardly extending side wall. In addition, the first and second annual walls further include notches such that in the opened configuration, the contents of the bottle which can flow to the notched segment.

In yet other aspects, the shell has an upper surface defined to include a lower portion interspaced between a portion of the upper surface, wherein the lower portion of the upper surface includes a pair of opposed partitions and wherein the closure further includes a downwardly extending stop flange configured between the pair of opposed partitions when the closure is secured to the shell.

Yet still further, the bottle shoulder further includes a plurality of bottle flanges and the outer shell wall has internally extending shell flanges, and wherein one or more shell flanges are configured to abut one or more bottle flanges when the shell is secured to the bottle.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE DRAWINGS

Figure 1:
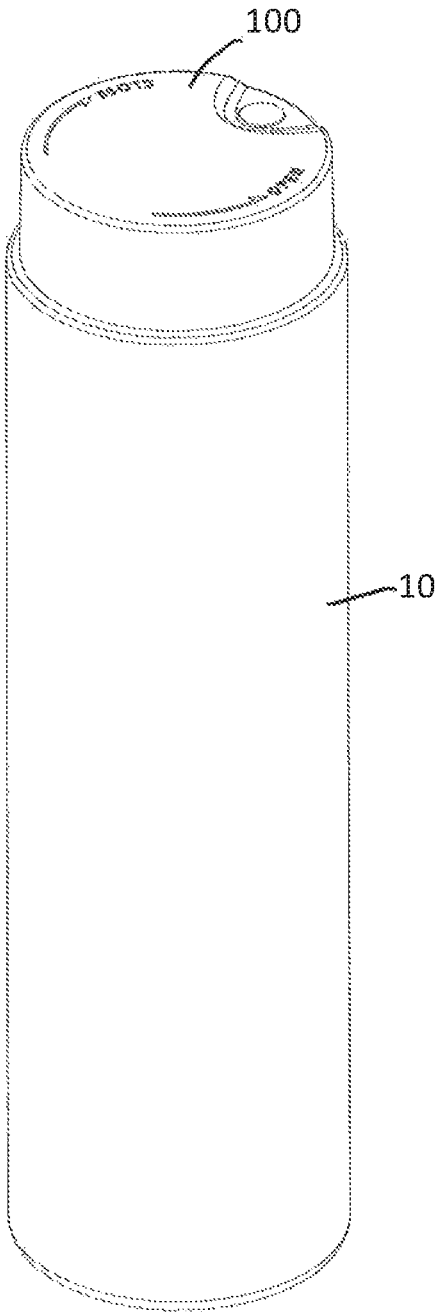
FIG. 1 is a perspective view of the bottle and closure in accordance with an embodiment of the invention.

While the invention is susceptible to embodiments in many different forms, there are shown in the drawings and will be described in detail herein the preferred embodiments of the present invention. It should be understood, however, that the present disclosure is to be considered an exemplification of the principles of the invention and is not intended to limit the spirit or scope of the invention and/or claims of the embodiments illustrated.

Figure 2:
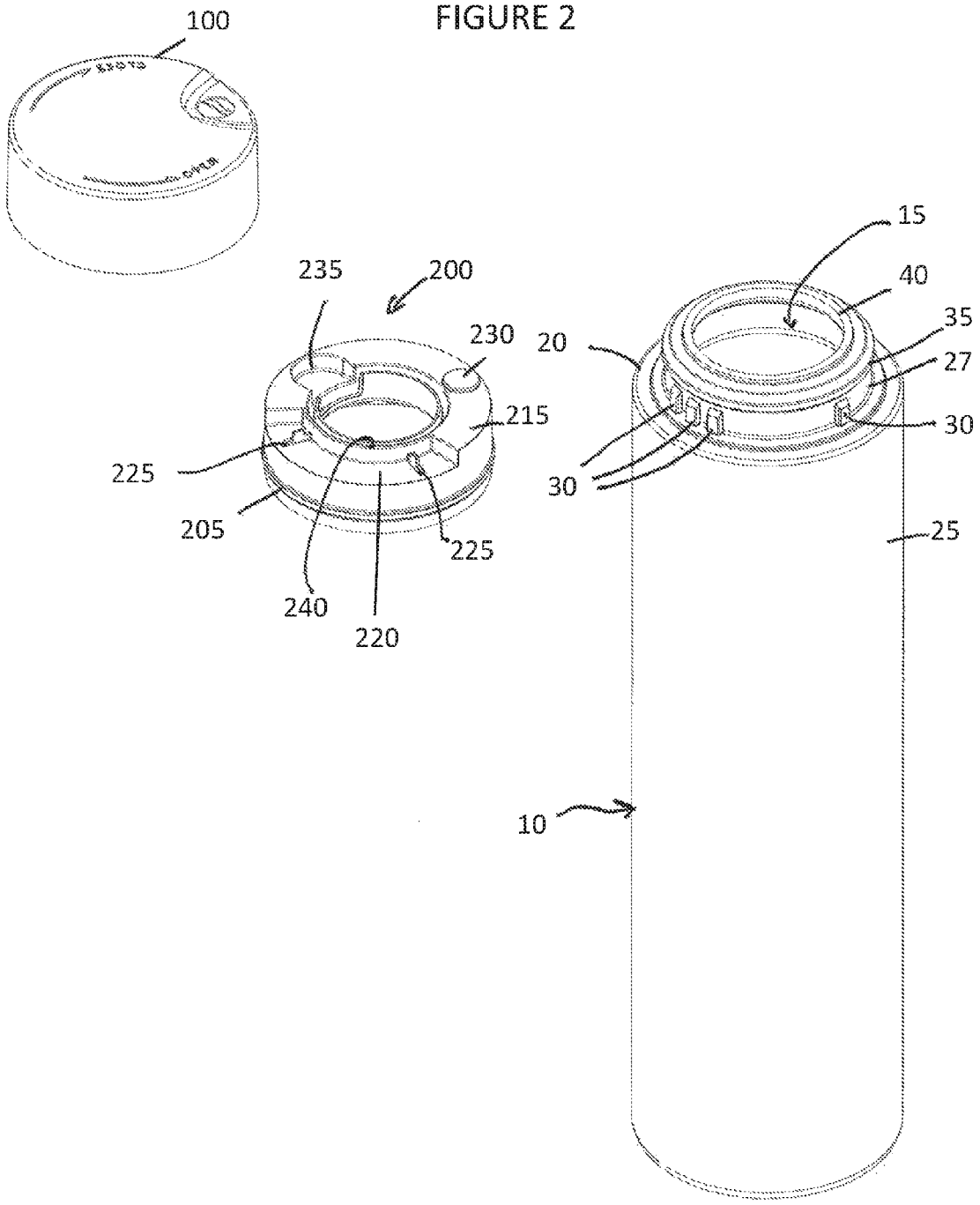
FIG. 2 is an exploded view of the bottle and closure in accordance with an embodiment of the invention.
Figure 3A:
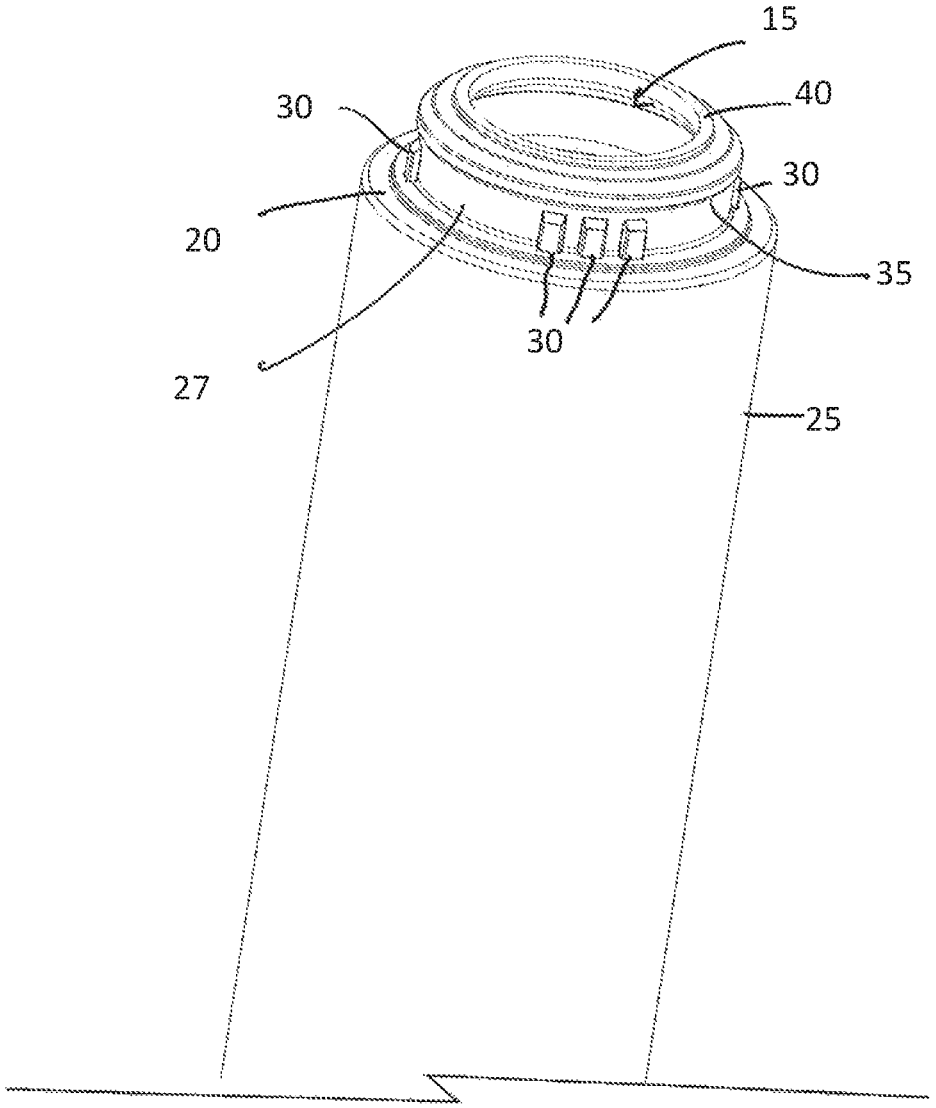
FIG. 3A is a partial perspective view of the bottle in accordance with an embodiment of the invention.
Figure 3B:
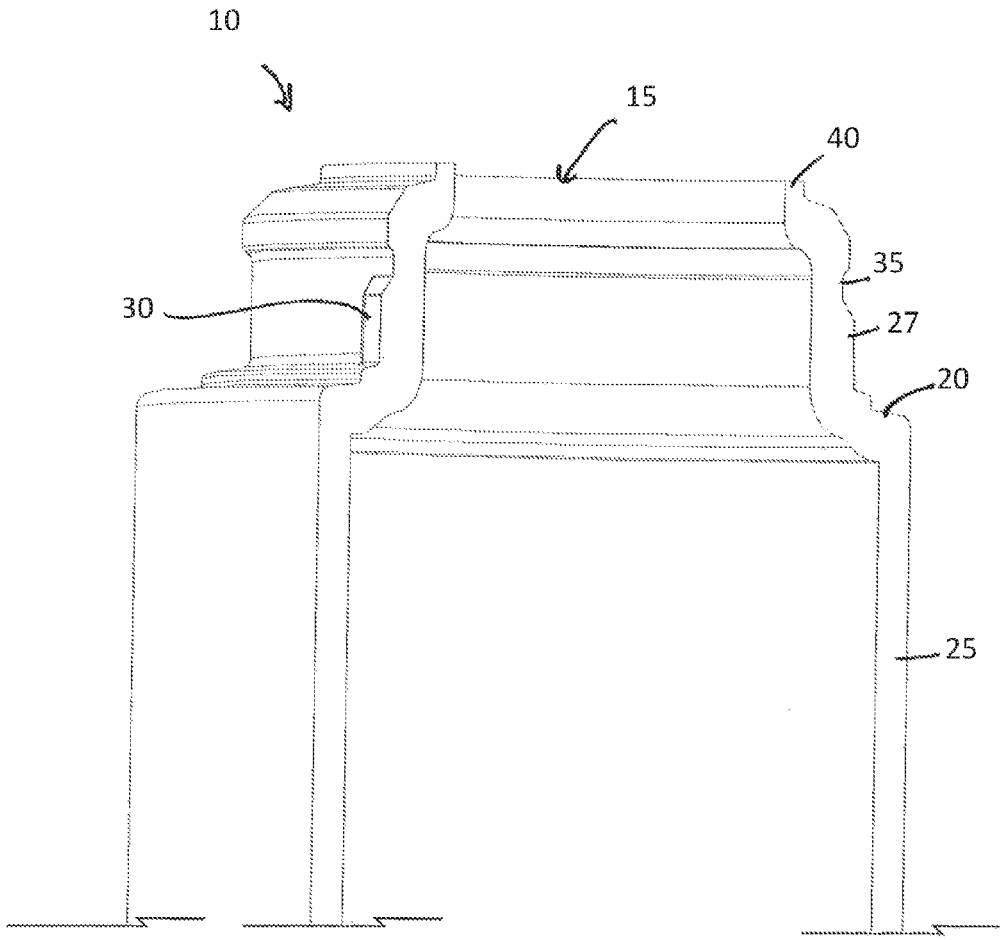
FIG. 3B is an enlarged partial perspective view of the bottle in accordance with an embodiment of the invention.
Figure 4:
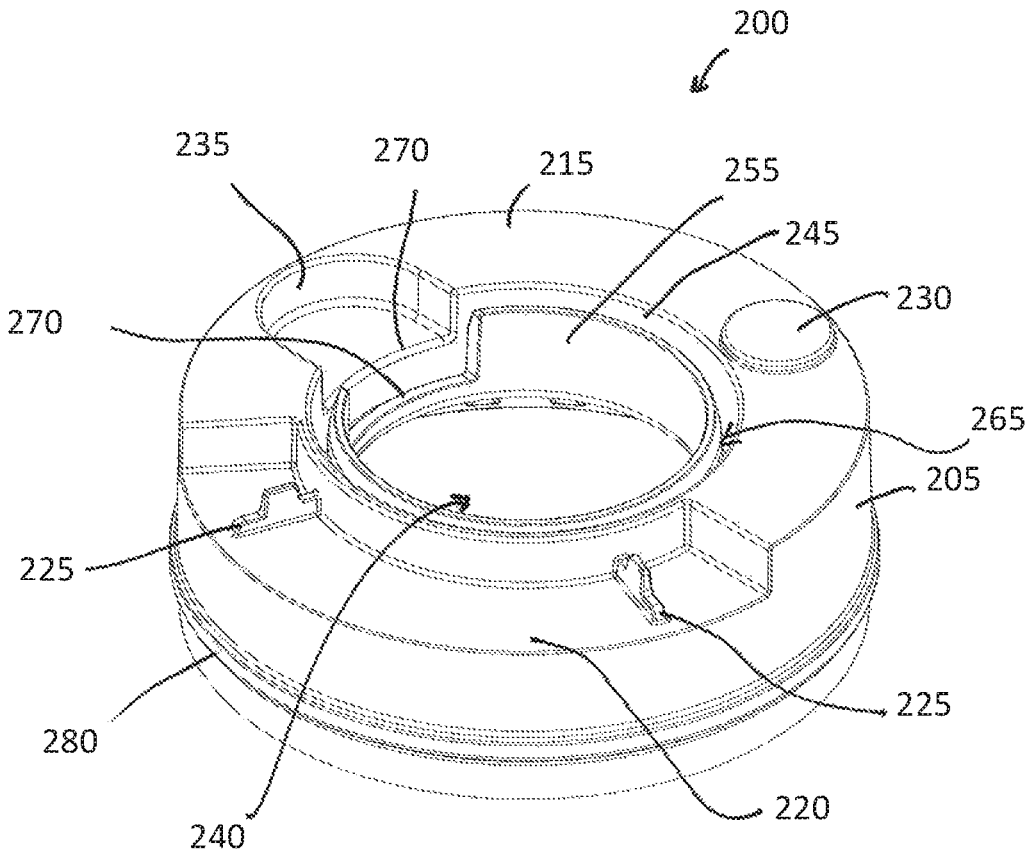
FIG. 4 is an enlarged perspective view of a shell that is positioned between the bottle and closure in accordance with an embodiment of the invention.
Figure 5:
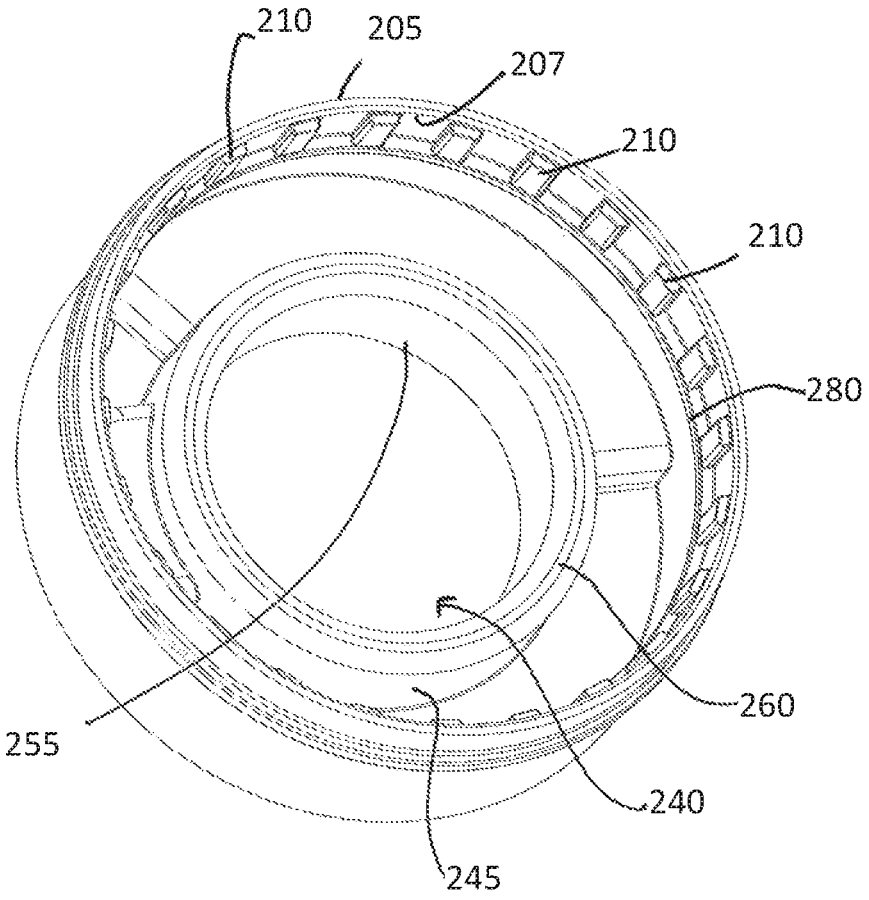
FIG. 5 is an underside perspective view of the shell from FIG. 4.
Figure 6:
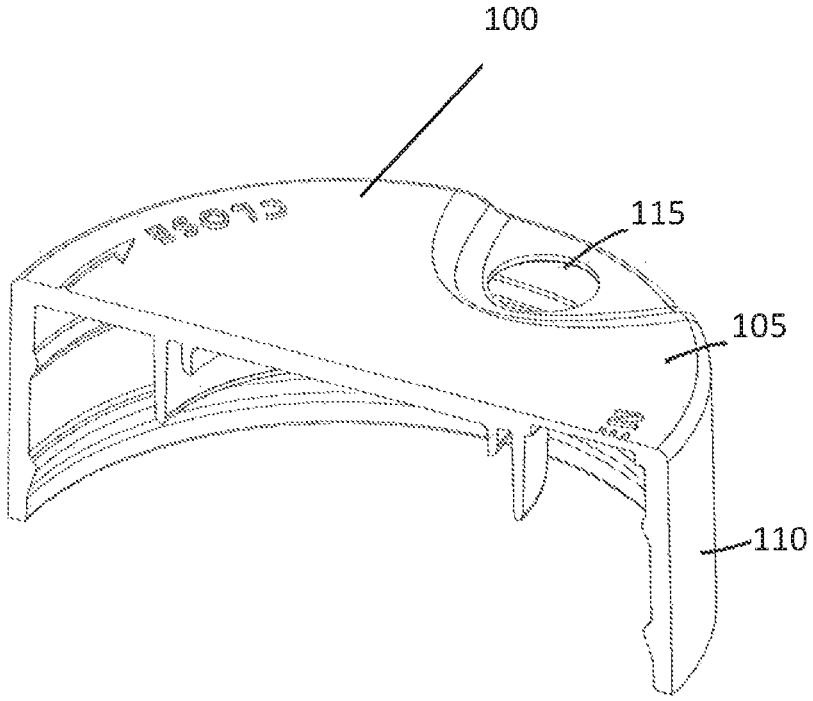
FIG. 6 is a partial perspective view of the bottle with the shell secured thereto and the cap removed in accordance with an embodiment of the invention.
Figure 6:
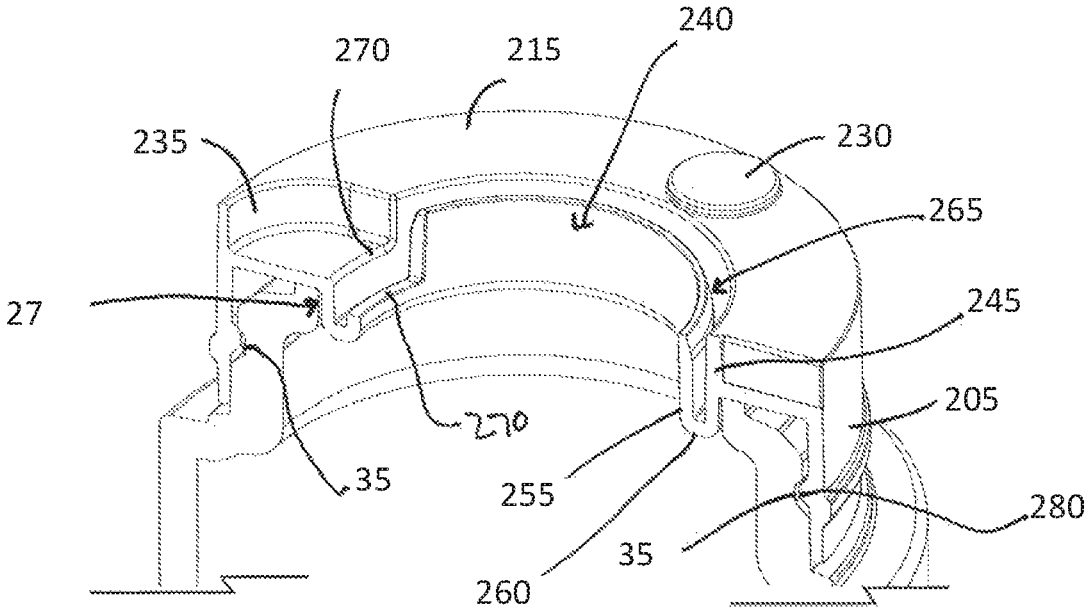
Figure 7A:
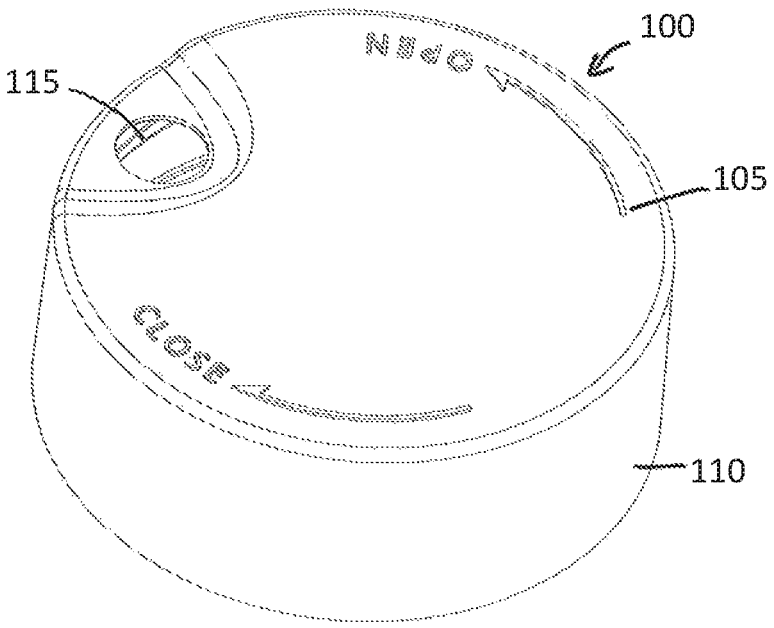
FIG. 7A is a partial perspective view of the closure in accordance with an embodiment of the invention.
Figure 7B:
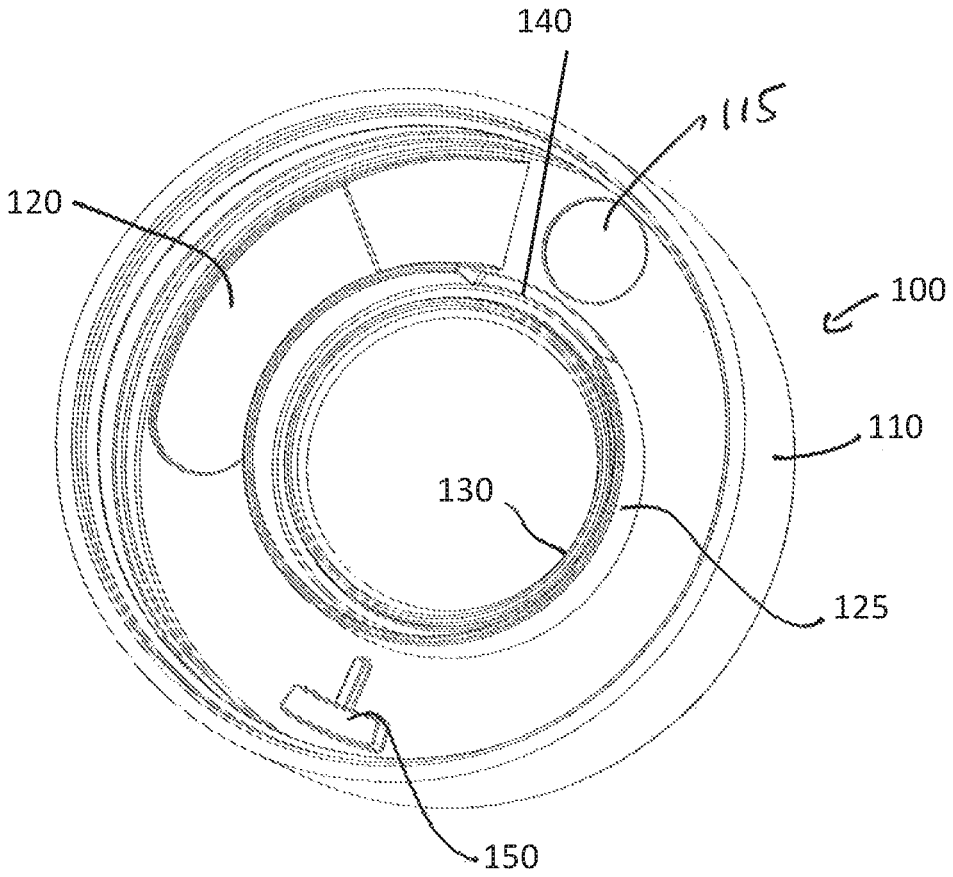
FIG. 7B is an underside perspective view of the closure from FIG. 7A.
Figure 8:
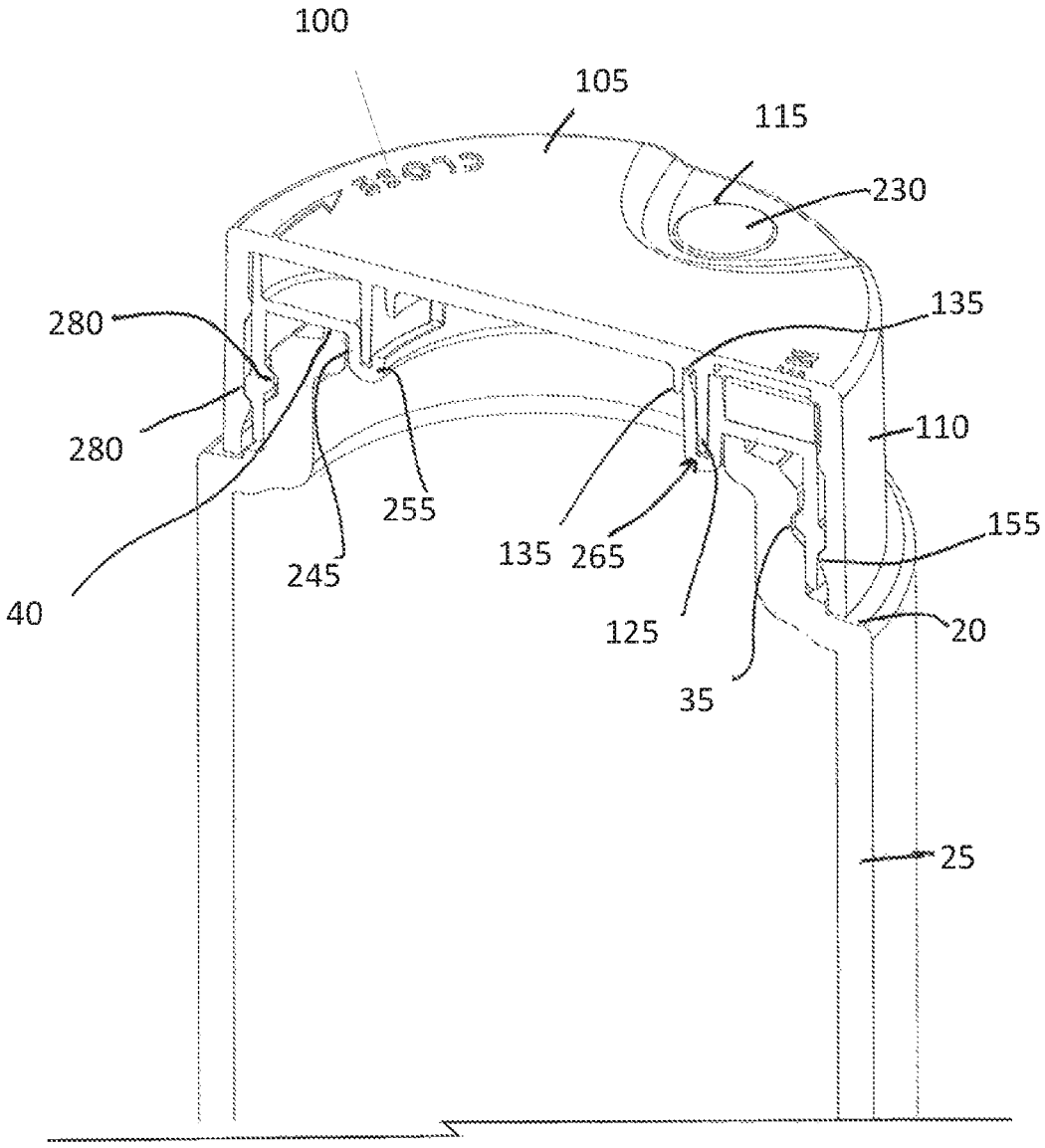
FIG. 8 is a cross sectional view of the bottle and closure in accordance with an embodiment of the invention.

Referring now to FIGS. 1-8, there is provided a twist closure 100 embodying the present invention. The closure 100 is adapted to attach about the opening of a container 10. The twist closure 100 is secured and movable over a shell 200 (defined in greater detail below), which is attached to the bottle 10. The bottle 10 includes a central bottle orifice 15 through which the contents of the bottle may flow there-through. The bottle 10 includes a bottle shoulder 20 extending inwardly from the bottle surface wall 25. The bottle shoulder 20 terminates to an upstanding bottle well 27 that surrounds the central bottle orifice 15. Positioned about the bottle shoulder 20 and against the upstanding bottle well 27 are bottle flanges 30. The bottle flanges 30 may be uniformly spaced about the bottle shoulder 20 or intermittently positioned. About the upper edge of the upstanding bottle well 27 is an indented ridge 35 and an upstanding lip 40 (discussed below).

The shell 200 includes an outer shell wall 205 annually extending around the shell 200 and having an inner surface 207 with internally extending shell flanges 210 that abut the bottle flanges 30 when the shell 200 is secured to the bottle 10. The shell flanges 210 and bottle flanges 30 act to prevent rotation of the shell 200 when secured to the bottle 10. The shell wall 205 terminates at an upper surface 215. The upper surface 215 includes a lower portion 220 that is interspaced between the rest of the upper surface 215. The lower portion 220 includes a pair of opposed partitions 225. The upper surface 215 further includes a raised segment 230 and a notched segment 235. The upper surface 215 further terminates annually towards a central well 240.

The central well 240 is defined by a first downwardly extending side wall 245 that is terminal to a central inner edge 250 defined on the upper surface 215 (such that the first downwardly extending side wall 245 forms an inside surface wall to the upper surface and when secured to the bottle an inside portion of the first side wall 245 abuts an inside portion of the bottle well 27). The central well 240 is further defined by a second downwardly extending side wall 255 positioned internally to the first downwardly extending side wall 245 and that forms a surface wall to the central well 240. The first and second downwardly extending side walls are connected to an annual base wall 260 positioned below the upper surface 215. The annual base wall 260 has length to create an annual channel 265 between the first and second downwardly extending side walls 245 and 255. The first and second downwardly extending side walls 245 and 255 further include notches 270 configured to be adjacent to the notched segment 235, such that when permitted the contents of the bottle are able to flow through the notches 270 in the first and second downwardly extending side walls into the notched segment 235. Lastly, the inner surface 207 includes an internally extending ring 280 formed to fit against the indented ridge 35 of the bottle when secured, further preventing separately between the shell and the bottle.

With respect to the twist closure 100, the closure 100 includes a top surface 105 with a downwardly extending skirt 110. The top surface 105 includes a top orifice 115 that is sized to receive the raised segment 230 such that when the raised segment 230 is positioned in the top orifice 115, the closure and bottle are in a closed configuration.

From the underside of the closure 100, the top surface 105 further includes a curved groove 120 that provides the raised segment 230 with a travel region when the closure 100 is twisting from the closed configuration to an open configuration which aligns the top orifice 115 with the notched segment 235. In addition, extending downwardly from the underside of the top surface 105 is a first annual wall 125 and a second annual wall 130 positioned inside of the first annual wall 125. The first and second annual walls are spaced 135 such that the first annual wall 125 fits into the channel 265 between the first and second downwardly extending side walls 245 and 255, with the second annual wall 130 abutting an inside portion of the second downwardly extending side wall 255. The first and second annual walls 125 and 130 further include notches 140 such that in the opened configuration, the contents of the bottle which can flow to the notched segment 235 is able to flow out of the top orifice.

The closure 100 further includes a downwardly extending stop flange 150 that when the closure 100 is secured over the shell 200 is positioned between the pair of opposed partitions 225. When twisting between the open and closed configurations the stop flange 150 will contact one of the opposed partitions 225 preventing further rotation and providing the user with an ability to determine when the closure is in the correct position.

The closure 100 may further include an annual ring 155 that positioned under a corresponding annual ring 280 on the outer shell wall 205 to help secure the closure onto the shell.

From the foregoing and as mentioned above, it is observed that numerous variations and modifications may be effected without departing from the spirit and scope of the novel concept of the invention. It is to be understood that no limitation with respect to the embodiments illustrated herein is intended or should be inferred. It is intended to cover, by the appended claims, all such modifications within the scope of the appended claims.

I claim:

1. A container comprising:

a bottle having a central bottle orifice through which contents of the bottle may flow through, the bottle having a bottle surface wall terminating to a bottle shoulder, the bottle shoulder extending to a bottle well surrounding the central bottle orifice;

a shell secured about the bottle well, the shell includes an outer shell wall annually extending around the bottle well, the shell further having an upper surface including a raised segment and a notched segment and terminating annually towards a central well positioned about the central bottle orifice, the central well includes first and second downwardly extending side walls, wherein the first and second downwardly extending side walls are connected to an annual base wall at a spaced distance to form an annual channel therebetween and wherein the first downwardly extending side wall is configured to abut an inside portion of the bottle well, and wherein the first and second downwardly extending side walls further include notches configured at an adjacent position to the notched segment; and a twist closure rotatably secured on to the shell, the twist closure having a top surface with a downwardly extending skirt fitted about the outer shell wall of the shell, the top surface having a top orifice sized to receive the raised segment when the twist closure is in a closed configuration about the bottle, the top orifice is configured to rotate to position over the notched segment when in an opened configuration allowing contents in the bottle to flow through the notches in the first and second downwardly extending side walls into the notched segment and out the top orifice, and wherein the shell further has an upper surface defined to include a lower portion interspaced between a portion of the upper surface wherein the lower portion of the upper surface includes a pair of opposed partitions and where the twist closure further includes a downwardly extending stop flange configured between the pair of opposed partitions when the twist closure is secured to the shell.

2. The container from claim 1, wherein the twist closure further includes a curved groove positioned in the top surface and configured to provide the raised segment with a travel region when the twist closure is rotating between the open and closed configurations.

3. The container from claim 1, wherein the twist closure includes first and second annual walls extending downwardly from an underside of the top surface, the first annual wall being spaced from the second annual wall such that the first annual wall is configured to fit into the channel between the first and second downwardly extending side walls, with the second annual wall abutting an inside portion of the second downwardly extending side wall, and wherein the first and second annual walls further include notches such that in the opened configuration, the contents of the bottle which can flow to the notched segment.

4. The container from claim 1, wherein the bottle shoulder further includes a plurality of bottle flanges and the outer shell wall has internally extending shell flanges, and wherein one or more shell flanges are configured to abut one or more bottle flanges when the shell is secured to the bottle.

5. The container claim 1, wherein the first downwardly extending side wall is terminal to a central inner edge defined on the upper surface of the shell such that the first downwardly extending side wall forms an inside surface wall to the upper surface.

6. The container from claim 1, wherein the second downwardly extending side wall forms a surface wall to the central well.

7. The container from claim 1, an inner surface of the outer sell further includes an internally extending ring formed to fit against an indented ridge formed on the bottle well when the shell is secured against the bottle.

8. A container comprising:

a bottle having a central bottle orifice through which contents of the bottle may flow through, the bottle having a bottle surface wall terminating to a bottle shoulder, the bottle shoulder extending to a bottle well surrounding the central bottle orifice;

a shell secured about the bottle well, the shell includes an outer shell wall annually extending around the bottle well, the shell further having an upper surface including a raised segment and a notched segment and terminating annually towards a central well positioned about the central bottle orifice, the central wall includes first and second downwardly extending side walls, wherein the first and second downwardly extending side walls are connected to an annual base wall at a spaced distance to form an annual channel therebetween and wherein the first downwardly extending side wall is configured to abut an inside portion of the bottle well, and wherein the first and second downwardly extending side walls further include notches configured at an adjacent position to the notched segment; and a twist closure rotatably secured on to the shell, the twist closure having a top surface with a downwardly extending skirt fitted about the outer shell wall of the shell, the top surface having a top orifice sized to receive the raised segment when the twist closure is in a closed configuration about the bottle, the top orifice is configured to rotate to position over the notched segment when in an opened configuration allowing contents in the bottle to flow through the notches in the first and second downwardly extending side walls into the notched segment and out the top orifice and wherein an inside portion of the first downwardly extending side wall is configured to abut an inside portion of the bottle well when the shell is secured to the bottle, and wherein an inside portion of the first downwardly extending side wall is configured to abut an inside portion of the bottle well when the shell is secured to the bottle.

9. The container from claim 8, wherein the twist closure further includes a curved groove positioned in the top surface and configured to provide the raised segment with a travel region when the twist closure is rotating between the open and closed configurations.

10. The container from claim 8, wherein the twist closure includes first and second annual walls extending downwardly from an underside of the top surface, the first annual wall being spaced from the second annual wall such that the first annual wall is configured to fit into the channel between the first and second downwardly extending side walls, with the second annual wall abutting an inside portion of the second downwardly extending side wall, and wherein the first and second annual walls further include notches such that in the opened configuration, the contents of the bottle which can flow to the notched segment.

11. The container from claim 8, wherein the shell further has an upper surface defined to include a lower portion interspaced between a portion of the upper surface wherein the lower portion of the upper surface includes a pair of opposed partitions and wherein the twist closure further includes a downwardly extending stop flange configured between the pair of opposed partitions when the twist closure is secured to the shell.

12. The container from claim 8, wherein the bottle shoulder further includes a plurality of bottle flanges and the outer shell wall has internally extending shell flanges, and wherein one or more shell flanges are configured to abut one or more bottle flanges when the shell is secured to the bottle.

13. The container from claim 8, wherein the first downwardly extending side wall is terminal to a central inner edge defined on the upper surface of the shell such that the first downwardly extending side wall forms an inside surface wall to the upper surface.

14. The container from claim 8, wherein the second downwardly extending side wall forms a surface wall to the central well.

15. The twist closure from claim 8, an inner surface of the outer shell further includes an internally extending ring formed to fit against an indented ridge formed on the bottle well when the shell is secured against the bottle.

* * * * *